US009476560B2

(12) United States Patent
Albou et al.

(10) Patent No.: US 9,476,560 B2
(45) Date of Patent: Oct. 25, 2016

(54) HEADLAMP PART COMPRISING A REFLECTING MEANS WITH A REFLECTION COEFFICIENT HIGHER THAN 90%

(71) Applicant: Valeo Vision, Bobigny (FR)

(72) Inventors: Pierre Albou, Paris (FR); Jean-Claude Puente, Livry Gargan (FR)

(73) Assignee: Valeo Vision, Bobigny (FR)

( * ) Notice: Subject to any disclaimer, the term of this patent is extended or adjusted under 35 U.S.C. 154(b) by 155 days.

(21) Appl. No.: 14/371,821

(22) PCT Filed: Feb. 15, 2013

(86) PCT No.: PCT/EP2013/053138

§ 371 (c)(1),
(2) Date: Jul. 11, 2014

(87) PCT Pub. No.: WO2013/121028

PCT Pub. Date: Aug. 22, 2013

(65) Prior Publication Data

US 2015/0043235 A1 Feb. 12, 2015

(30) Foreign Application Priority Data

Feb. 16, 2012 (FR) ..... 12 51452

(51) Int. Cl.
*F21S 8/10* (2006.01)
*F21Y 101/02* (2006.01)

(52) U.S. Cl.
CPC ..... *F21S 48/1394* (2013.01); *F21S 48/115* (2013.01); *F21S 48/1225* (2013.01); *F21S 48/15* (2013.01); *F21S 48/238* (2013.01); *F21S 48/25* (2013.01); *F21S 48/31* (2013.01); *F21S 48/145* (2013.01); *F21Y 2101/02* (2013.01)

(58) Field of Classification Search
CPC ..... F21S 48/1394; F21S 48/115; F21S 48/1225; F21S 48/31; F21S 48/25; F21S 48/15; F21S 48/238; F21S 48/145
See application file for complete search history.

(56) References Cited

U.S. PATENT DOCUMENTS

| | | | | |
|---|---|---|---|---|
| 3,601,471 | A | 8/1971 | Seddon | |
| 7,530,718 | B2 | 5/2009 | Ono | |
| 2007/0230203 | A1* | 10/2007 | Ono | F21S 48/1394 362/516 |

FOREIGN PATENT DOCUMENTS

| | | |
|---|---|---|
| EP | 2112429 | 10/2009 |

* cited by examiner

*Primary Examiner* — Anne Hines
(74) *Attorney, Agent, or Firm* — Jacox, Meckstroth & Jenkins

(57) ABSTRACT

A part for an illuminating and/or signaling device of an automotive vehicle, comprising at least one body made of a polymer, at least one section of this body being able, when the part is mounted inside the illuminating device, to be exposed to rays from the sun after they have been focused by a focusing device of the illuminating device, characterized in that the section comprises a reflecting means the reflection coefficient of which is higher than 90%.

19 Claims, 2 Drawing Sheets

HEADLAMP PART COMPRISING A REFLECTING MEANS WITH A REFLECTION COEFFICIENT HIGHER THAN 90%

CROSS-REFERENCE TO RELATED APPLICATIONS

This application claims priority to PCT Application PCT/EP2013/053138 filed Feb. 15, 2013, and also to French Application No. 1251452 filed Feb. 16, 2012, which are incorporated herein by reference and made a part hereof.

BACKGROUND OF THE INVENTION

1. Field of the Invention

The technical field of the present invention is that of illuminating and/or signaling devices for automotive vehicles, and more particularly that of internal parts made of plastic equipping such devices.

2. Description of the Related Art

A headlamp mounted on an automotive vehicle is conventionally composed of a housing closed by a transparent element thus bounding an internal volume in which a light source, a focusing device and components that participate in the delivery of a photometric function are found.

Certain of these components receive rays from the sun, which enter into the headlamp via the transparent element. In such a situation, the focusing device concentrates rays from the sun on these components, which may lead to these components degrading under the action of the rays from the sun when these rays are at least partially focused. Such a situation is encountered when the vehicle equipped with this headlamp is in a horizontal position whereas the sun is high above the horizon line.

This problem was corrected in the prior art by placing an opaque shield on the focusing element, which shield prevents rays from the sun entering. Such a shield forms a sort of eyelid against rays from the sun. Although satisfactory with regard to the aforementioned problem, such a solution is not completely acceptable as it decreases the area passed through by the light beam, especially when the latter forms a "high" beam since the opaque shield blocks the passage of at least a portion of the beam generated by the light source.

Thus, the most exposed components are manufactured from a metal capable of withstanding the temperature increase resulting from this focusing. This is especially the case for a cutting-off device installed in the headlamp with a view to defining a cut-off in a "low" beam.

However, using a metal makes it harder to produce precise complex shapes that have the small sizes that are required for a cutting-off device when the latter is combined with very wide aperture lenses. It is then necessary to carry out machining rework to produce these complex and precise shapes.

Apart from being difficult to carry out, this reworking is expensive. Moreover, it is difficult to make machining rework compatible with the production rates of low-cost parts intended for the automotive industry.

What is needed, therefore, is a system and method that overcomes one or more of the problems in the prior art.

SUMMARY OF THE INVENTION

The invention provides a solution that avoids using metal for the components exposed to focused rays from the sun, while allowing them to withstand the temperature increase resulting from this focusing of rays from the sun.

The aim of the present invention is therefore to solve the drawbacks described above mainly via production of a plastic part that is at least partially covered with a means capable of reflecting at least 90% of the focused rays originating from the sun.

Therefore, one subject of the invention is a part for an illuminating and/or signaling device of an automotive vehicle, comprising at least one body made of a polymer, at least one section of this body being able, when the part is mounted inside the illuminating device, to be exposed to rays from the sun after they have been focused by a focusing device of the illuminating device, wherein the section comprises a reflecting means the reflection coefficient of which is higher than 90%.

Such a solution solves the technical problem since rays from the sun, these rays being the source of the degradation, are reflected so that the temperature in line with the focal point is decreased. Such a decrease widens the range of usable polymers to those that have conventionally been ruled out because they are unable to withstand high temperatures.

The advantage of such a technical solution lies in the fact that it becomes possible to use plastics with low production costs to manufacture these parts, thereby, correlatively, allowing the manufacturing cost of such a part, especially of the cutting-off device, to be decreased.

The reflecting means is a reflective coating that covers the section. Such a coating is particularly simple to apply to the part and may thus be implemented in an industrial manufacturing process.

It will be noted that the reflective coating contains silver particles. This is one embodiment of the reflecting means allowing the reflection coefficient of 90% to be achieved.

Advantageously, the reflective coating contains an aluminized first layer and a second layer containing the silver particles. Such a solution has the advantage of producing some of the desired reflection by means of an aluminized layer the production cost of which is low, and of employing a small amount of silver in the second layer, the function of which is to reflect an additional quantity of rays relative to the first layer, in order to achieve the reflection coefficient of 90%.

Thus, the aluminized first layer is arranged to reflect up to 85% of the rays, the remainder up to 90% being reflected by the second layer. In order for the first layer to reflect up to 85%, aluminum or aluminum-alloy particles are applied with a view to forming a reflective layer.

As an alternative to the layer containing silver particles, the reflecting means comprises an interference mirror.

Such an interference mirror comprises a plurality of dielectric layers that ensure constructive interference for a reflected portion of the rays and destructive interference for a transmitted portion of the rays.

Advantageously, an aluminized first layer is provided between the body and the interference mirror, the aluminized first layer being arranged to reflect up to 85% of the rays, the remainder up to 90% being reflected by the interference mirror.

The polymer is chosen from thermoplastics and/or thermosets. Advantageously, the polymer is a polybutylene terephthalate or a polycarbonate. The advantage lies in the fact that the cost of using and the manufacturing method of this material are compatible with the cost of the photometric function.

A part such as described above is preferably a device for cutting off a light beam emitted by the illuminating and/or signaling device. This cutting-off device is also called a deflector.

The invention also relates to an optical module comprising a light source, a reflecting means, a focusing device and a device for cutting off a light beam generated by the light source, such a cutting-off device being a part such as described above.

Lastly the invention encompasses an illuminating and/or signaling device comprising a module such as described above and/or at least one part having any one of the features specified above.

Other features, details and advantages of the invention will become more clearly apparent on reading the description given below by way of illustration and with reference to the drawings in which:

BRIEF DESCRIPTION OF THE ACCOMPANYING DRAWINGS

DETAILED DESCRIPTION OF THE PREFERRED EMBODIMENTS

Figure 1:
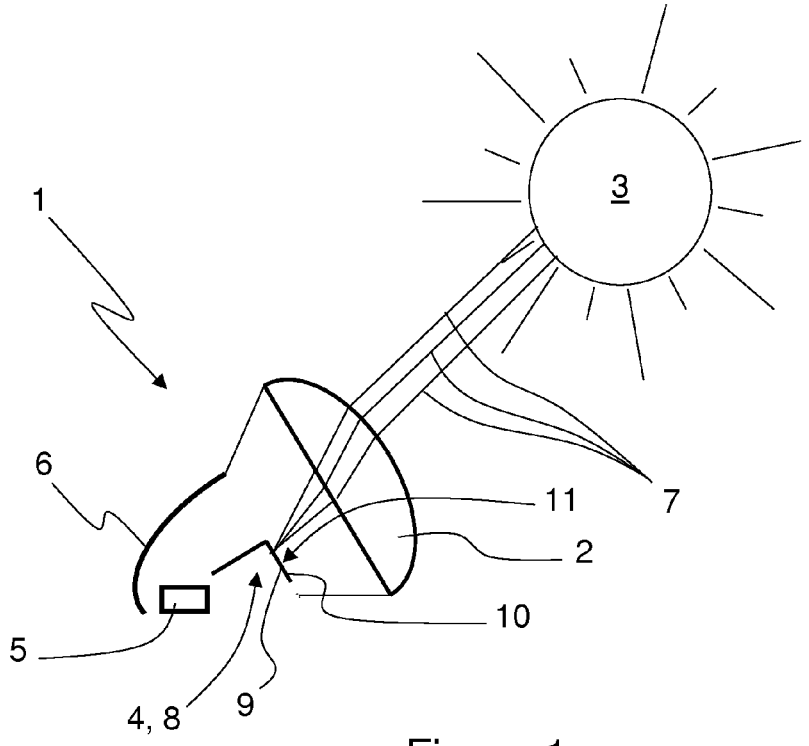
FIG. 1 is a schematic illustrating the part according to the invention installed in an optical module.

FIG. 1 illustrates the invention and the temperature increase problem generated by the focusing of rays from the sun. An optical module 1 mounted in an illuminating and/or signaling device (not shown) comprises a focusing element 2. In the embodiment in FIG. 1, this focusing element 2 is a lens with a planar face and a convex face that is turned toward the sun. The latter is here referenced 3 and is placed high above the horizon line.

The illuminating and/or signaling device is for example a front headlamp of an automotive vehicle.

A part 4 according to the invention is also installed inside the illuminating and/or signaling device and in particular inside the optical module 1. The latter also comprises a light source 5, for example an LED light source, and a reflecting means 6 intended to reflect the rays emitted by the light source 5 with a view to providing a photometric function, for example of the "low-beam" type.

Rays 7 emitted by the sun 3 are focused by the focusing element 2 and are thus concentrated on the part 4. By way of example, the following description will be given in relation to a cutting-off device 8 that generates a cut-off line for a "low-beam" photometric function, but it goes without saying that the invention also encompasses any other part of the illuminating and/or signaling device liable to see its surface degraded by a temperature increase generated by rays originating from the sun 3 and focused by the focusing element 2.

The cutting-off device 8 is formed by a body 9 made of a polymer commonly called a plastic. Advantageously, the polymer is a thermoplastic and/or a thermoset, especially a polyester. By way of example, the polymer is a polybutylene terephthalate (PBT) or a polycarbonate (PC).

This choice of material is particularly relevant in that they are easy to implement by molding, thereby allowing the complex and precise shapes required for a cutting-off device 8 to be produced with ease. Moreover, the production cost of these materials is compatible with the financial constraints of the automotive industry.

This part 4, or this cutting-off device 8, comprises at least one section 10 onto which rays 7 from the sun 3 are focused. Such a section is covered by a reflecting means 11 the reflection coefficient of which is higher than 90%. This reflecting means 11 will be described in detail with reference to FIG. 3, but generally it is a question of any device that can be applied to a plastic body and that is capable of reflecting 90% of the rays 7 that strike it.

The invention encompasses the case where only the section 10 of the cutting-off device 8 exposed to the focusing of rays 7 from the sun 3 is protected by the reflecting means 11, but the invention also encompasses the case where the entirety of one face of this cutting-off device 8 is covered by the reflecting means 11.

The value of 90% for the reflection coefficient is chosen in order to guarantee the temperature is kept below a threshold, so as not to degrade the structure of the part that receives the focused rays 7 from the sun 3.

This value especially extends at least into a near infrared spectrum. By way of example, a near infrared spectrum is comprised between wavelengths of 2 microns and 780 nanometers.

Figure 2:
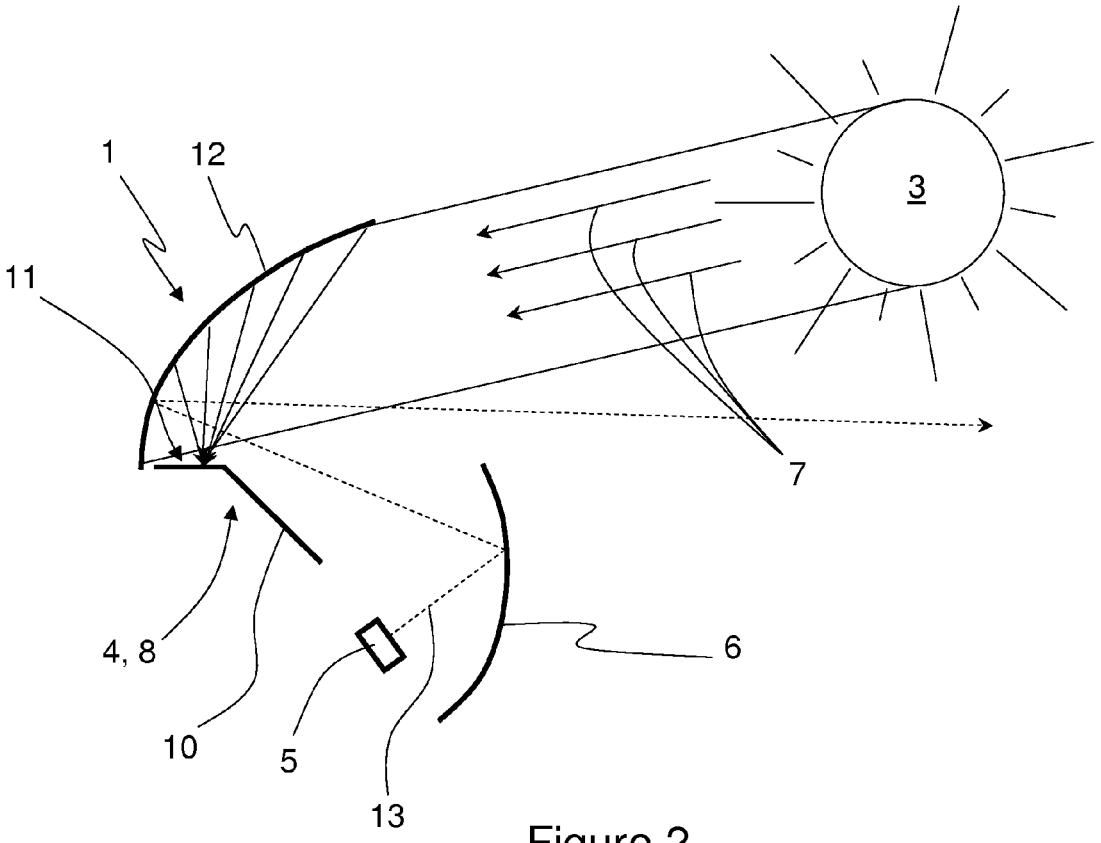
FIG. 2 is a schematic cross-sectional view of a variant embodiment of an optical module comprising the part according to the invention.

FIG. 2 shows a variant of the optical module in FIG. 1. The focusing device is not a lens but here is a paraboloidal reflector or a like mirror, both referenced 12.

In order to provide a photometric function, the light source 5 emits light rays 13 that strike a reflecting means 6. The latter reflects these rays 13 toward the paraboloidal reflector 12, a portion of the rays 13 being cut off and redirected by the cutting-off device 8 installed in this variant of the optical module 1, for the case of a "low-beam" photometric function.

Similarly to FIG. 1, situations arise in which rays 7 from the sun 3 are concentrated on a section 10 of the cutting-off device 8 by the focusing device, here the paraboloidal reflector 12.

To protect this cutting-off device 8, in this variant of the optical module 1 the invention makes provision for a reflecting means 11 to be arranged on the body of this cutting-off device 8, in order to reflect 90% of the rays 13 received originating from the paraboloidal reflector 12.

Such a reflecting means 11 is applied to the body of the part 4 in one or more layers. This application may be carried out by electrolysis or in a vacuum environment.

Figure 3:
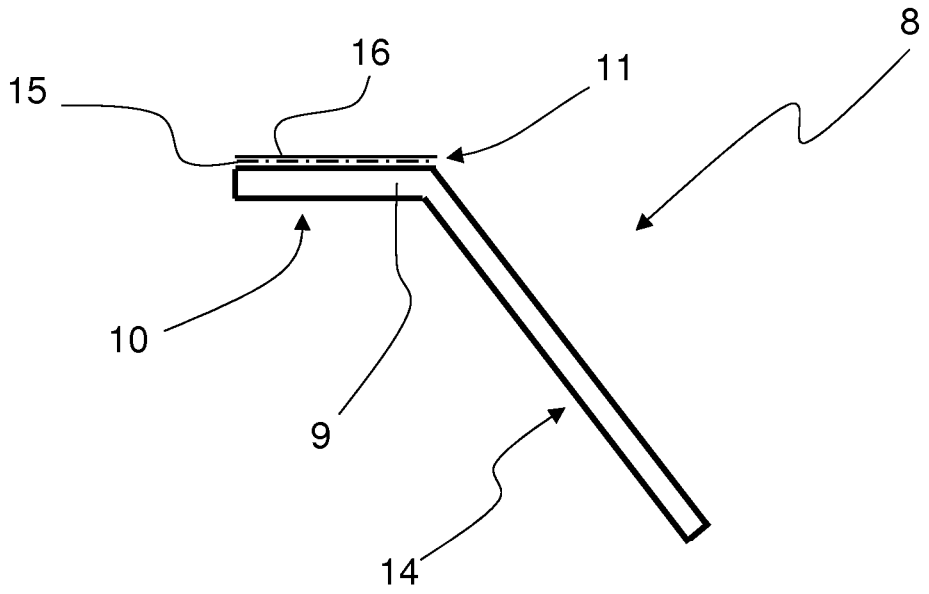
FIG. 3 is a cross-sectional view showing the structure of the part according to the invention in detail.

FIG. 3 shows one embodiment of this reflecting means 11, applied to the cutting-off device 8 shown in FIG. 2. It goes without saying that the features described below may also be transposed to the cutting-off device 8 in the variant of the optical module 1 illustrated in FIG. 1.

The cutting-off device 8 is shown in cross section, but it forms an elongate strip comprising a portion 14 for reflecting the light beam emitted by the light source 5, and the section 10 that the invention aims to protect from temperature increases resulting from the focusing of rays 7 from the sun 3.

Such a portion 10 forms a support from which the reflecting portion 14 extends. This support is the mechanical link between this reflecting portion 14 and the rest of the optical module 1, and it is also called a "pivot".

By way of example, the reflecting means 11, the reflection coefficient of which is higher than 90%, is exclusively placed on the portion 10 forming the support. Alternatively, the reflecting means 11 may also cover both the portion 10 forming the support and the reflecting portion 14.

The reflecting means 11 is a reflective coating. It may especially be a coating that contains silver particles that are secured to the cutting-off device 8 by electrolysis or by vacuum deposition.

Preferably, because of the cost of these silver particles, the reflective coating is made up of at least one aluminized first layer 15 and a second layer 16 containing the silver particles, the aluminized first layer 15 being interposed between the body 9 and the second layer containing the silver particles. The thickness of such a second layer is comprised between 1 and 10 microns.

Such a structure allows up to 85% of the focused rays originating from the sun to be reflected by means of the first layer 15, and the remainder to be reflected, to reach 90%, using the second layer 16 containing the silver particles.

According to an alternative embodiment, provision is made, according to the invention, for the reflecting means 11 to comprise an interference mirror. Such a mirror is then placed on the part 4 and takes the form of a plurality of layers manufactured from a dielectric plastic material. In such a case, certain layers ensure constructive optical interference for a reflected portion of the rays 7, and another series of layers generates destructive interference for a transmitted portion of the rays 7. Such an interference mirror achieves a reflection coefficient at least equal to 90% while also enabling its combination with a cutting-off device 8, for example, and more generally with any part of the illuminating and/or signaling device liable to see its temperature increased due to the focusing of rays 7 from the sun 3 entering into the illuminating and/or signaling device, to be envisioned.

To limit the cost of the interference mirror, the latter advantageously combines an aluminized first layer 15 inserted between the body 9 and the interference mirror. This first layer 15 is aluminized in order to reflect up to 85% of the rays, the remainder up to 90% being reflected by the interference mirror.

The aluminized layer 15 described in the above variants is a layer of aluminum or an aluminum alloy secured to the body of the part 4 according to the invention.

Thus, since the temperature in line with the zone onto which rays 7 from the sun 3 are focused is decreased, the invention allows commonplace plastics to be used to manufacture parts that, in the prior art, were made of metal.

While the system, apparatus, process and method herein described constitute preferred embodiments of this invention, it is to be understood that the invention is not limited to this precise system, apparatus, process and method, and that changes may be made therein without departing from the scope of the invention which is defined in the appended claims.

What is claimed is:

1. A part for an illuminating and/or signalling device of an automotive vehicle, comprising at least one body made of a polymer, at least one section of said at least one body being able, when said part is mounted inside said illuminating and/or signalling device, to be exposed to rays from the sun after they have been focused by a focusing device of said illuminating and/or signalling device, wherein said at least one section comprises a reflecting means the reflection coefficient of which is higher than 90%;

in which said reflecting means is a reflective coating that covers said at least one section;

in which said reflective coating contains silver particles;

in which said reflective coating contains an aluminized first layer and a second layer containing said silver particles.

2. The part as claimed in claim 1, in which said aluminized first layer is arranged to reflect up to 85% of the rays coming from the sun, the remainder up to 90% being reflected by said second layer.

3. The part as claimed in claim 1, which said polymer is chosen from thermoplastics and/or thermosets.

4. The part as claimed in claim 1, in which said polymer is a polybutylene terephthalate or a polycarbonate.

5. The part as claimed in claim 1, in that said part is a device for cutting off a light beam emitted by the illuminating and/or signaling device.

6. The cutting-off device as claimed in claim 5, comprising a portion for reflecting a light beam and a section forming a support for said reflecting portion, the reflecting means the reflection coefficient of which is higher than 90% being placed at least on the section forming a support.

7. An optical module for an automotive vehicle, comprising at least one light source, a reflecting means, a focusing device and a cutting-off device as claimed in claim 6.

8. An optical module for an automotive vehicle, comprising at least one light source, a reflecting means, a focusing device and a cutting-off device as claimed in claim 5.

9. A part for an illuminating and/or signaling device of an automotive vehicle, comprising at least one body made of a polymer, at least one section of said at least one body being able, when said part is mounted inside said illuminating and/or signaling device, to be exposed to rays from the sun after they have been focused by a focusing device of said illuminating and/or signalling device, wherein said at least one section comprises a reflecting means the reflection coefficient of which is higher than 90%;

in which said reflecting means comprises an interference mirror.

10. The part as claimed in claim 9, in which said interference mirror comprises a plurality of dielectric layers that ensure constructive interference for a reflected portion of the rays and destructive interference for a transmitted portion of the rays.

11. The part as claimed in claim 9, in which an aluminized first layer is provided between said at least one body and said interference mirror, said aluminized first layer is arranged to reflect up to 85% of the rays, the remainder up to 90% being reflected by said interference mirror.

12. A part for an illuminating and/or signaling device of an automotive vehicle, comprising at least one body made of a polymer, at least one section of said at least one body being able, when said part is mounted inside said illuminating and/or signaling device, to be exposed to rays from the sun after they have been focused by a focusing device of said illuminating and/or signalling device, wherein said at least one section comprises a reflecting means the reflection coefficient of which is higher than 90%;

in which said reflecting means is a reflective coating that covers said at least one section;

in which said reflecting means comprises an interference mirror.

13. An optical module for an automotive vehicle, comprising at least one light source, a reflecting means, a focusing device and a cutting-off device as claimed in claim 12.

14. A part for an illuminating and/or signaling device of an automotive vehicle, comprising at least one body made of a polymer, at least one section of said at least one body being able, when said part is mounted inside said illuminating and/or signaling device, to be exposed to rays from the sun after they have been focused by a focusing device of said illuminating and/or signalling device, wherein said at least one section comprises a reflecting means the reflection coefficient of which is higher than 90%;

in which said reflecting means is a reflective coating that covers said at least one section;

in which said reflective coating contains silver particles;

in which said reflecting means comprises an interference mirror.

15. A part for an illuminating and/or signaling device of an automotive vehicle, comprising at least one body made of a polymer, at least one section of said at least one body being able, when said part is mounted inside said illuminating and/or signaling device, to be exposed to rays from the sun after they have been focused by a focusing device of said illuminating and/or signalling device, wherein said at least one section comprises a reflecting means the reflection coefficient of which is higher than 90%;

in which said reflecting means is a reflective coating that covers said at least one section;

in which said reflective coating contains silver particles;

in which said reflective coating contains an aluminized first layer and a second layer containing said silver particles;

in which said reflecting means comprises an interference mirror.

16. A part for an illuminating and/or signaling device of an automotive vehicle, comprising at least one body made of a polymer, at least one section of said at least one body being able, when said part is mounted inside said illuminating and/or signaling device, to be exposed to rays from the sun after they have been focused by a focusing device of said illuminating and/or signalling device, wherein said at least one section comprises a reflecting means the reflection coefficient of which is higher than 90%;

in which said reflecting means is a reflective coating that covers said at least one section;

in which said reflective coating contains silver particles;

in which said reflective coating contains an aluminized first layer and a second layer containing said silver particles;

in which said aluminized first layer is arranged to reflect up to 85% of the rays coming from the sun, the remainder up to 90% being reflected by said second layer;

in which said reflecting means comprises an interference mirror.

17. A part for an illuminating and/or signaling device of an automotive vehicle, comprising at least one body made of a polymer, at least one section of said at least one body being able, when said part is mounted inside said illuminating and/or signaling device, to be exposed to rays from the sun after they have been focused by a focusing device of said illuminating and/or signalling device, wherein said at least one section comprises a reflecting means the reflection coefficient of which is higher than 90%;

in which said reflecting means comprises an interference mirror;

in which said interference mirror comprises a plurality of dielectric layers that ensure constructive interference for a reflected portion of the rays and destructive interference for a transmitted portion of the rays;

in which said aluminized first layer is provided between said at least one body and said interference mirror, said aluminized first layer is arranged to reflect up to 85% of the rays, the remainder up to 90% being reflected by said interference mirror.

18. A part for an illuminating and/or signaling device of an automotive vehicle, comprising at least one body made of a polymer, at least one section of said at least one body being able, when said part is mounted inside said illuminating and/or signaling device, to be exposed to rays from the sun after they have been focused by a focusing device of said illuminating and/or signalling device, wherein said at least one section comprises a reflecting means the reflection coefficient of which is higher than 90%;

in which said reflecting means is a reflective coating that covers said at least one section;

in which said reflective coating contains silver particles;

in which said reflective coating contains an aluminized first layer and a second layer containing said silver particles;

in which said aluminized first layer is arranged to reflect up to 85% of the rays coming from the sun, the remainder up to 90% being reflected by said second layer;

in which said polymer is chosen from thermoplastics and/or thermosets.

19. A part for an illuminating and/or signaling device of an automotive vehicle, comprising at least one body made of a polymer, at least one section of said at least one body being able, when said part is mounted inside said illuminating and/or signaling device, to be exposed to rays from the sun after they have been focused by a focusing device of said illuminating and/or signalling device, wherein said at least one section comprises a reflecting means the reflection coefficient of which is higher than 90%;

in which said reflecting means is a reflective coating that covers said at least one section;

in which said reflective coating contains silver particles;

in which said reflective coating contains an aluminized first layer and a second layer containing said silver particles;

in which said aluminized first layer is arranged to reflect up to 85% of the rays coming from the sun, the remainder up to 90% being reflected by said second layer;

in which said polymer is a polybutylene terephthalate or a polycarbonate.

* * * * *